US006694536B1

(12) United States Patent
Haygreen

(10) Patent No.: US 6,694,536 B1
(45) Date of Patent: Feb. 24, 2004

(54) FRAGRANT WATER CLOSET CLOSER

(76) Inventor: Basil Haygreen, 707 W. 5th Ave. #A, Mesa, AZ (US) 85210

( * ) Notice: Subject to any disclaimer, the term of this patent is extended or adjusted under 35 U.S.C. 154(b) by 0 days.

(21) Appl. No.: 10/219,439

(22) Filed: Aug. 14, 2002

(51) Int. Cl.[7] ..... A47K 13/10
(52) U.S. Cl. ..... 4/246.1; 4/222
(58) Field of Search ..... 4/246.1, 246.2, 4/222

(56) References Cited

U.S. PATENT DOCUMENTS

| | | | | |
|---|---|---|---|---|
| 2,011,404 | A | | 8/1935 | Giliasso |
| 2,200,687 | A | | 5/1940 | Bercot |
| 3,579,664 | A | | 5/1971 | Johnson |
| 4,491,989 | A | | 1/1985 | McGrail |
| 4,519,105 | A | | 5/1985 | Blanck |
| 4,577,350 | A | * | 3/1986 | Clark ..... 4/246.1 |
| 4,839,928 | A | | 6/1989 | Probasco |
| 4,887,322 | A | | 12/1989 | Lydon |
| 4,912,783 | A | | 4/1990 | Shafer |
| 5,014,367 | A | * | 5/1991 | Gamblin ..... 4/246.2 |
| 5,058,216 | A | * | 10/1991 | Trayer et al. ..... 4/246.2 |
| 5,060,318 | A | | 10/1991 | Jaskiewicz |
| 5,101,518 | A | * | 4/1992 | Phillips ..... 4/246.2 |
| 5,430,897 | A | | 7/1995 | Lavender |
| 5,488,744 | A | | 2/1996 | Paananen |
| 5,592,700 | A | | 1/1997 | Genesse |
| 5,642,532 | A | | 7/1997 | Morant |
| 5,675,845 | A | * | 10/1997 | Martin et al. ..... 4/228.1 |
| 5,689,838 | A | | 11/1997 | MacKenzie |
| 5,754,985 | A | | 5/1998 | Dias |
| 5,774,904 | A | | 7/1998 | McWilliams |
| 5,781,938 | A | | 7/1998 | Anderson |
| 5,862,532 | A | * | 1/1999 | Cain ..... 4/228.1 |
| 5,878,444 | A | * | 3/1999 | Convoy ..... 4/246.1 |
| 5,907,873 | A | | 6/1999 | Brandolf |
| 6,000,069 | A | | 12/1999 | Sorimachi |
| 6,009,568 | A | | 1/2000 | Miyazaki |
| 6,081,936 | A | | 7/2000 | Bargman et al. |
| 6,321,393 | B1 | | 11/2001 | Jones |

* cited by examiner

*Primary Examiner*—Charles E. Phillips
(74) *Attorney, Agent, or Firm*—Schmeiser, Olsen & Watts LLP

(57) ABSTRACT

An apparatus is disclosed that pushes a toilet seat down automatically by exerting a force based on gas pressure wherein the pressurized gas has a fragrance and the fragrant gas is released into the atmosphere by operation of the apparatus. In one embodiment, a predetermined amount of fragrant, pressurized gas may push a piston to a first distance, which piston exerts a force to push the upright seat closure to an unstable, descending position, and thereafter the piston moves to a greater, second distance, opening a vent to dispense the fragrant gas into the room. In a second embodiment, the fragrant, pressurized gas is directed against the seat through an extending bellows which sealingly engages the toilet seat or cover when the seat or cover is in the upright position. When fragrant, pressurized gas is channeled to the bellows, the bellows maintains its seal for a short time while the pressure rises to push the seat over. Additional embodiments are also presented. The source of pressurized gas may be a pressurized gas cannister of any convenient shape or size. The fragrance may be in the gas cannister originally or the fragrance may be entrained by the gas as it moves from the cannister to the room. In a third embodiment, a module comprising a container of fragrant pressurized gas, a consumer-adjustable nozzle, and an actuator button adapted to be pressed by the flush lever in flushing the toilet, is attached to the toilet tank. The descent of the seat is slowed, for safety, by a torsional damper on the seat axle, a pad of resilient material near the axle, a bellows, or similar means. The apparatus may be activated, directly or indirectly, by various means, such as flushing the toilet or stepping away from the toilet.

31 Claims, 8 Drawing Sheets

FRAGRANT WATER CLOSET CLOSER

BACKGROUND OF THE INVENTION

1. Technical Field

This invention generally relates to an apparatus for automatically closing a seat on a water closet, and more specifically to combinations of air fresheners with apparatuses for automatically closing a seat on a water closet.

2. Background

Complaints from women about the inability of men to put the toilet seat down after use are legion and legendary. (Never heard are complaints about women not putting the seat up after use!) Numerous approaches for automatically closing a seat on a water closet, or toilet, or commode, have been patented. None have met with notable commercial success. Some of the patented inventions are unsightly, some are difficult to clean, some are too expensive, and some are not safe for use around small children.

Accordingly, what is needed is an automatic toilet seat closing device that is inexpensive, easy to clean, not unattractive, and safe.

SUMMARY OF THE INVENTION

A fragrant water closet closer is presented that puts the seat down automatically using the force of gas pressure. The pressurized gas includes a fragrance and the fragrant gas is released into the atmosphere by operation of the apparatus. In one embodiment, a predetermined amount of fragrant, pressurized gas may push a piston to a first distance, which piston exerts a force to push the upright seat closure to an unstable, descending position, and thereafter the piston moves to a greater, second distance, opening a vent to dispense the fragrant gas into the room. In a second embodiment, the fragrant, pressurized gas is directed against the seat through an extending bellows which sealingly engages the toilet seat or cover when the seat or cover is in the upright position. When fragrant, pressurized gas is channeled to the bellows, the bellows maintains its seal for a short time while the pressure rises to push the seat over. Additional embodiments are also presented. The source of pressurized gas may be a pressurized gas cannister of any convenient shape or size. The fragrance may be in the gas cannister originally or the fragrance may be entrained by the gas as it moves from the cannister to the room. In a third embodiment, a module comprising a container of fragrant pressurized gas, a consumer-adjustable piston, and an actuator button adapted to be pressed by the flush lever in flushing the toilet, is attached to the toilet tank. The gas may be a mixture of gases, including air. The descent of the seat is slowed, for safety, by a torsional damper on the seat axle, a pad of resilient material near the axle, a bellows, or similar means. A seat-decelerating bellows is disclosed which may expel fragrant air. The apparatus may be activated, directly or indirectly, by various means, such as flushing the toilet or stepping away from the toilet.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a fragrant water closet, or toilet, closer. As used herein, "toilet seat" refers to a toilet seat, toilet seat cover, or both. Likewise, "toilet" and "water closet" are used interchangeably.

Figure 1B:
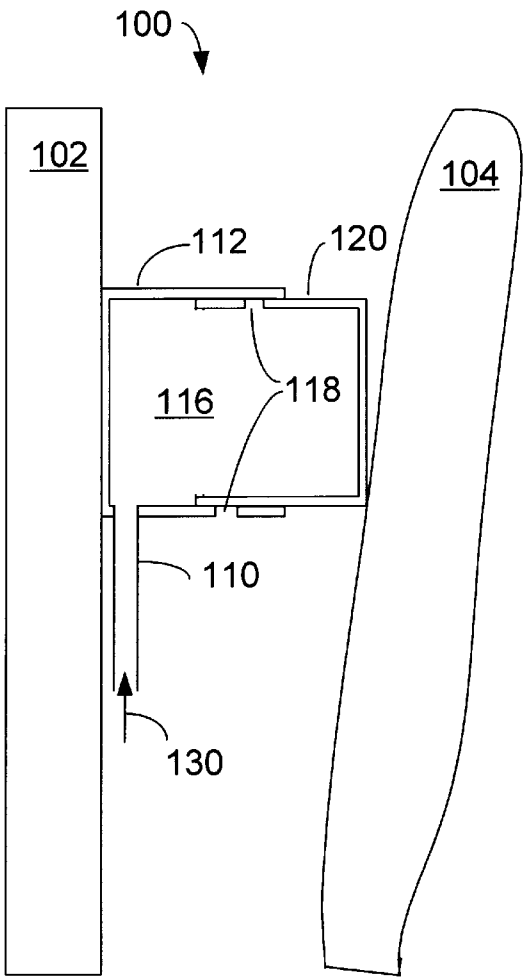
FIG. 1A–1D shows an example of a portion of an embodiment of the fragrant water closet closer in three stages of operation and an exemplary adjustable piston.
Figure 1A:
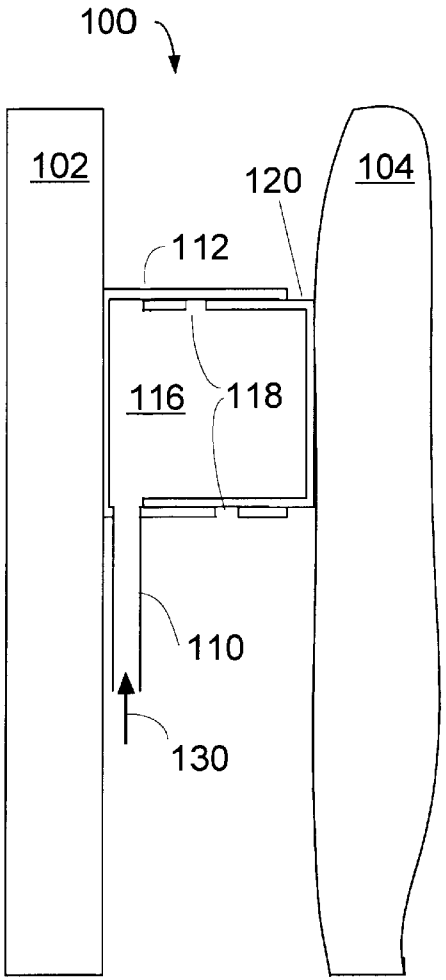

FIG. 1A shows a side view of a portion of a fixed surface which may be toilet tank wall 102. Cylinder 112 is attached to toilet tank wall 102 by an adherent surface. In alternate versions, the attachment of cylinder 112 to toilet tank wall 102 may be by means of a bracket (220/FIG. 2), strap (220/FIG. 6), fixture, or clamp. In one embodiment, a circumferential strap (220/FIG. 6) on the toilet tank wall 102 holds one or more cylinders 112. Cylinder 112 slidingly receives piston 120 to form expandable chamber 116. The travel of piston 120 is limited to prevent the piston from completely exiting the cylinder (features not shown). Either the cylinder 112, the piston 120, or both has at least one vent 118. The vent 118 opens after the piston 120 extends away from the toilet tank wall 102 beyond a sufficient distance to push the toilet seat 104 to an unstable position, from which position gravity will force the toilet seat 104 to fall.

The piston 120 is shown in FIG. 1A in a non-extended position. The piston 120, cylinder 112, and attachment to the tank wall 102 are sized so that piston 120 engages the toilet seat 104 such that the seat 104 is in a barely stable upright position. From this position, a small push will close the seat 104. Piston 120 extends when pressurized gas 130 is introduced though channel 110 to pressurize expandable chamber 116. Pressurized gas 130 may be a combination of gases and may be air. Pressurized gas 130 may be fragranced before it enters expandable chamber 116. In an alternate embodiment, the fragrance is introduced in the expandable chamber 116. For example, a solid fragrance that dissolves in air, as is known in the art, may be placed in the expandable chamber 116 on the inside of the cylinder 112 wall or piston. During periods of inactivity, the gas in the expandable chamber 116 will saturate with fragrance. When pressurized gas 130 is introduced to the expandable chamber 116, the pressurized gas 130 and the fragrance will first mix as the chamber expands, and then be vented into the atmosphere.

FIG. 1B shows the piston 120 in a partially extended position. Vents 118 are not yet open, but the toilet seat 104 has been pushed to an unstable position. Pressurized gas 130 continues to enter the expandable chamber 116.

Figure 1D:
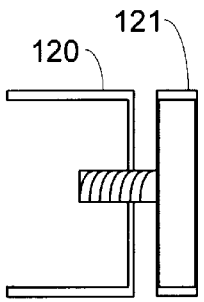
Figure 1C:
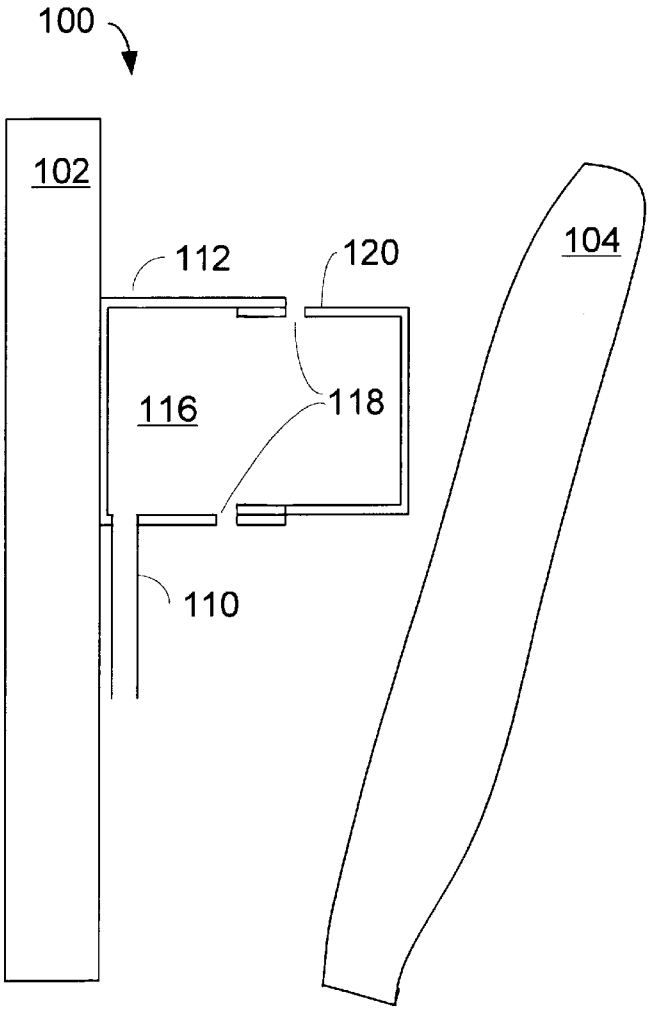

FIG. 1C shows the piston 120 fully extended. Vents 118 are shown open. The flow of pressurized gas 130 has stopped. Channel 110 is open to the atmosphere at some point between the expandable chamber 116 and the source of the compressed gas 130, as will be explained in more detail below. This allows the piston 120 to be returned to the non-extended position (FIG. 1A) when the seat 104 is next lifted or by the pressure of a hand.

FIG. 1D shows a variation of the piston 120, wherein piston 120 further comprises an adjustable extension 121. The adjustable extension 121 can be adjusted by the consumer to adapt the piston 120 to receive the seat 104 at the barely stable upright position. A screw-type adjustment is shown, but other approaches to making the length of an object adjustable are known to those of ordinary skill in the art.

Figure 2:
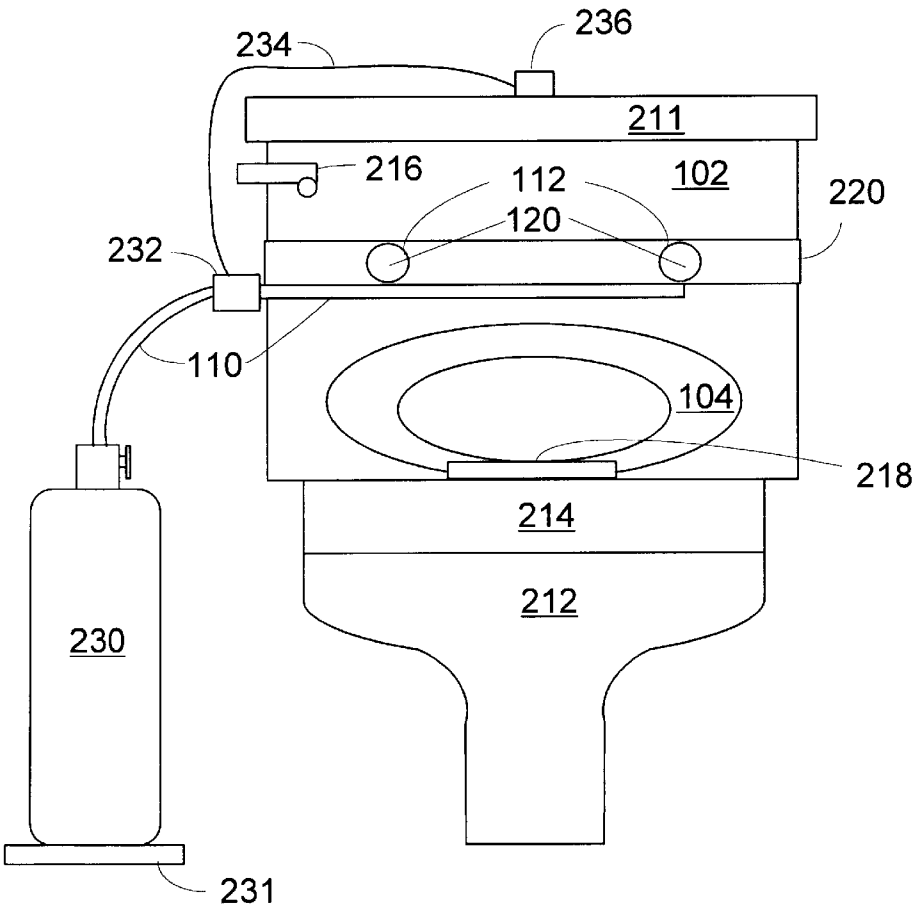
FIG. 2 shows a first exemplary embodiment of the fragrant water closet closer and a toilet.

FIG. 2 shows a fragrant water closet closer attached to a conventional toilet. The toilet has a base 212, a rim 214, a tank having walls 102 and a lid 211, a hinged seat 104, and a flush lever 216. The fragrant water closet closer comprises a supply of compressed gas 230 connected by a gas-conducting channel 110 through solenoid 232 and then to cylinders 112 and pistons 120. The solenoid 232 is controlled by sensor 236 communicating at least one of activation and deactivation to the solenoid 232 over line 234. In a particular alternate version, line 234 may be replaced with a wireless link, such as an infrared link. The sensor 236, the solenoid 232, and associated signal electronics (not shown) together form an actuator for actuating the flow of compressed gas 130 (FIG. 1) to the expandable chamber 116 (FIG. 1).

Sensor 236 may detect a person leaving the vicinity of the toilet, as is known in the art. The circuitry required to translate a sensor 236 state change into an activation or deactivation signal is included in sensor 236. Sensor 236 may be placed in any convenient location: the illustration in FIG. 2 is notional. Alternate versions of sensor 236 may detect the sound of the toilet flushing, motion near the flush lever, motion of the flush lever, motion of any part of the flushing mechanism within the tank 102, or a drop in the water level inside the toilet tank 102. The electronic devices and the solenoid may be battery powered. In a variant, the electronics are powered by batteries or power adapters and the solenoid uses household current. In an alternate embodiment, the fragrant water closet closer will dispense fragrant gas upon sensing the arrival of a person at the toilet.

In an alternate embodiment, the solenoid 232 may flush the toilet and channel the compressed gas 130 to the expandable chamber 116. Solenoid 232 may be located as shown or may be connected anywhere between the supply of compressed gas 230 and the expandable chambers 116. In a particular version, solenoid 232 is attached directly to the supply of compressed gas 230.

FIG. 2 also shows the pistons 120 and cylinders 112 mounted on a bracket 220. The bracket 220 may be circumferential to the tank 102. In alternate versions, the means for attaching the pistons 120 and cylinders 112 may comprise a clamp, fixture, strap, or adherent surface. Adherent surfaces may be hook and loop fasteners such as VELCRO or may be adhesive surfaces. The placement of the pistons 120 and cylinders 112 on a bracket 220, strap, or clamp should be adjustable as to position on the bracket 220, etc. to enable a consumer to adapt the apparatus to a particular toilet. The placement of the bracket 220 on the tank 102 should also be adjustable. The higher the pistons 120 are placed on the tank, the greater the leverage for pushing the seat 104 closed, but the farther the pistons 120 must extend. In a particular installation, one piston 120 may be positioned to close the seat 104 and another piston 120 may be positioned to close the cover (not shown). In another particular installation, both pistons may be positioned to close the toilet seat 104. In yet another particular installation, both pistons 120 may be positioned to close the cover (not shown) and carry the seat 104 down with the cover. The fragrant water closet closer may be adjusted to many different toilet designs. In particular embodiments, there may be only one piston 120. In other particular embodiments, there may be more than two pistons 120.

The diameter of piston 120 and cylinder 112 depend on the pressure of the supply of pressurized gas 230. From the design of the toilet and the location for the piston 120 on the tank 102, the force required to tip the seat 104 closed can be calculated. The area of the piston 120 inner face is then calculated as the force divided by the pressure available from the supply of pressurized gas 230, as delivered to the cylinder 112. The diameter of the piston 120 inner face is then calculated as the square root of (area/pi). A ten percent engineering margin is appropriate. The lower the pressure of the pressurized gas 130, the bigger the piston 120.

The supply of compressed gas may be held stable by base 231. The compressed gas supply 230 includes, as required, any valves, channels, and seals required to channel the compressed gas 130 to the solenoid 232. The compressed gas supply 230 may be of various types and sizes. For example, compressed gas supply 230 may be an industrial compressed air line in a factory or a laboratory, an air compressor, and industrial air bottle, a scuba tank, a fire extinguisher bottle filled with compressed gas, a can of compressed air such as those used for air horns, a can of air freshener, a $CO_2$ cartridge such as those used in BB guns, similar commercially available compressed gas containers, or a can of compressed gas customized for this apparatus. Depending on the size and type, the compressed gas supply 230 may be located in any convenient place. For example, the compressed gas supply 230 may be located in a different room, may be attached to the toilet tank 102, or may be hidden under the bathroom sink. The compressed gas supply may be refillable by the consumer, as by a separate foot pump or motorized pump, such as those used for inflating tires using automobile battery power.

For those versions of the compressed gas supply 230 that are containers of compressed gas 130, the supply of fragrance may be contained within the compressed gas supply 230. That is, compressed gas supply 230 may be compressed fragrant gas supply 230. The primary requirements for the gas is that it be non-reactive with the fragrance and compatible with people. For a counter-example, some "air horn" gases contain 1,1,1,2 tetraflourcethane, which causes frostbite in contact with human skin. Such a gas must be used with great care in this application.

Figure 6:
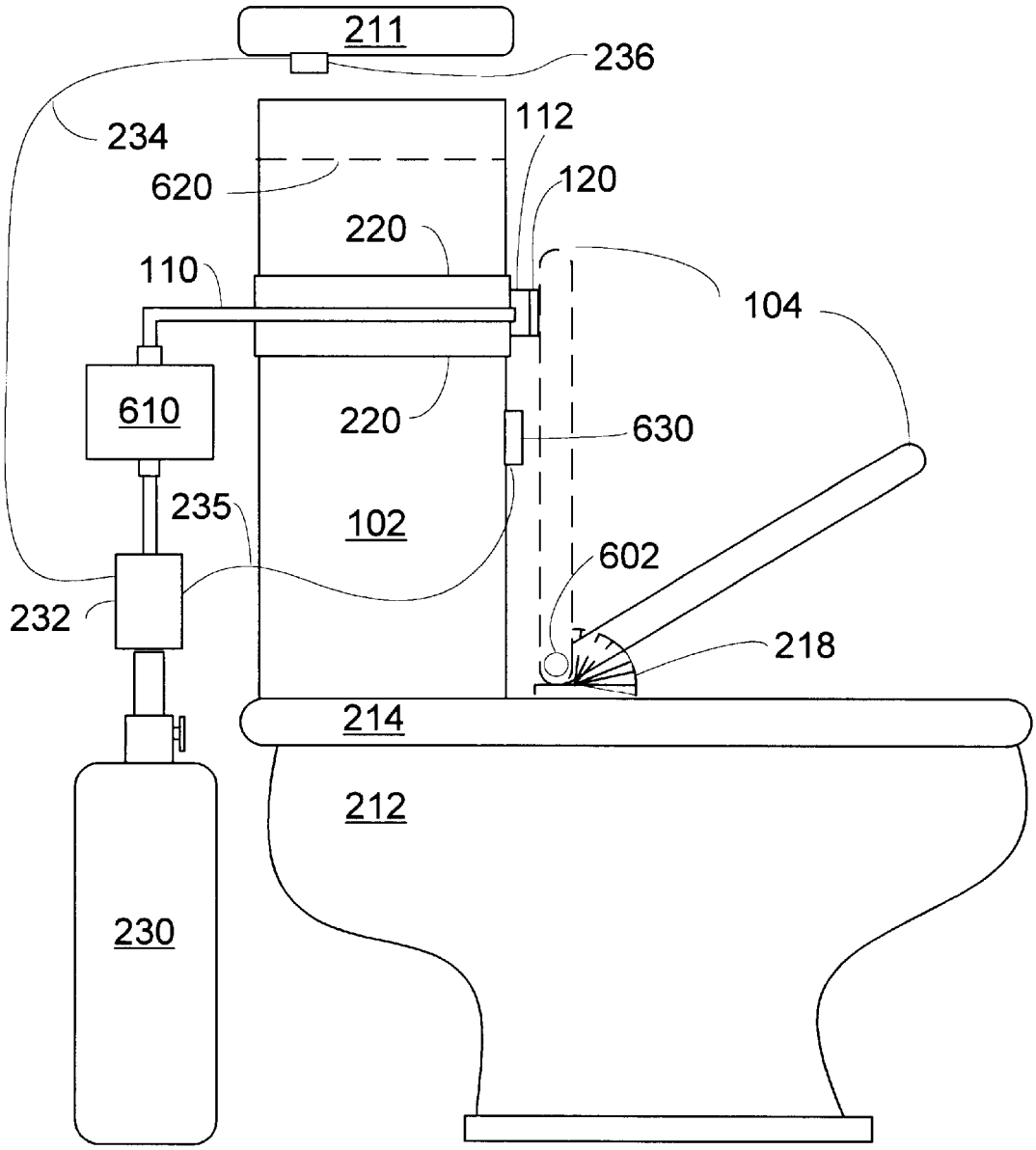
FIG. 6 shows a side view of the first exemplary embodiment of the fragrant water closet closer.
Figure 7A:
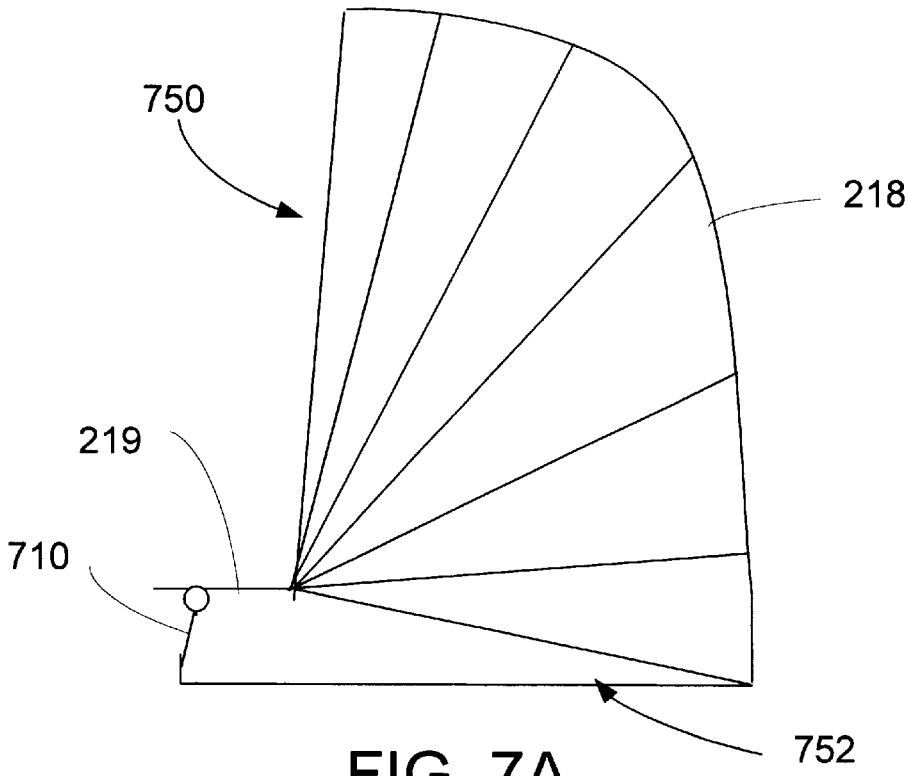
FIGS. 7A–C show views of an example of an embodiment of a toilet seat decelerator portion of an example of the first embodiment of the fragrant water closet closer.
Figure 7B:
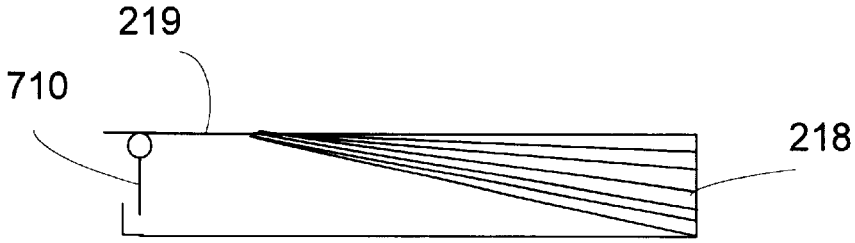
Figure 7C:
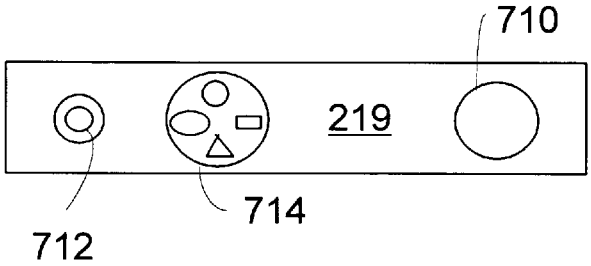

Damper 218 slows the descent of the seat 104. Damper 218 may be any of the devices known in the art, such as torsional dampers of various sorts or may be a bellows. Refer to FIGS. 6–7C. The bellows 218 variant may be an accordion type with two flat surfaces 750 and 752 at opposite ends of an expandable middle tube. Surfaces 750 and 752 may be adherent surfaces for purposes of attachment. For example, adhesive surfaces, glued surfaces, or hook and eye surfaces may be used. Mechanical attachments may be substituted or added. Mechanical attachments may include screws, bolts, locks, latches, hinges, snap-lock fittings, pins, clamps, and any other device known to hold two surfaces together mechanically. A first bellows 218 end is attached to the under side of the seat 104 and the second bellows 218 end is attached to the top of the toilet rim 214. When the toilet seat 104 is down, the bellows 218 is deflated (FIG. 7B). When the seat 104 is lifted, the bellows 218 inflates through an orifice 712 and a valve 710, possibly a flapper valve 710, producing no more than trivial resistance to lifting the seat. FIG. 7B shows the flapper valve 710 open, as the bellows 218 begins expansion from the fully collapsed state. Preferably, the flapper valve 710 is on an extension 219 (FIGS. 7A–7B) of the bellows 218, allowing the flapper valve 710 and orifice 712 to face away from the toilet bowl. The bellows 218 may contain a coil, or helical, spring as an expansion constraint around a flexible tube portion of the bellows 218, but the spring should be a weak one that allows the seat 104 to remain upright once lifted. When the seat 104 is pushed to an unstable position by piston 120, the bellows 218 begins to deflate. FIG. 7A shows the bellows beginning to deflate.

When the seat 104 falls, the flapper valve 710 takes a moment to close, allowing the seat 104 to gain a small initial velocity above that which the piston 120 could impart. When the flapper valve 710 closes, as shown in FIG. 7A, the bellows 218 pressurizes, as the only avenue for air to escape is through a small orifice 712, as shown in FIG. 7C. This pressurization resists the closing of the seat 104. As the air leaks out through the orifice 712, the seat 104 descends to the closed position. In an amusing variant, the orifice is connected to a noise-maker, such as a whistle or a whoopee cushion nozzle. The noise can serve to warn children that the seat is descending, or to inspire guys to lower the seat. In particular versions, the size of the orifice 712 is adjustable. In particular alternate versions, different sounds, or no sound, may be selected by turning a rotatable array 714 of noise-makers to align a particular noise-maker to an orifice which is behind rotatable array 714 in this alternate version also shown in FIG. 7C. (I.e., either 712 or 714, but not both). The bellows 218 may be releasably attachable, so that it is easier to clean. In a particular embodiment, the bellows 218 may contain a supply of fragrance. For example, an air freshener solid that slowly dissolves in air can be inserted through the flapper valve 710 or through a dedicated opening (not shown), so that the decelerating bellows 218 becomes a source of fragrant pressurized air that is released to the atmosphere when the toilet seat 104 lowers.

In a particular embodiment, a disinfectant or non-fragrant odor neutralizer may be substituted for the air freshener in the bellows 218, and the orifice 712 may be configured to vent disinfectant or non-fragrant odor neutralizer into the toilet bowl. Some disinfectants may also be fragrant. In a variation of this embodiment, the orifice 712 may be configured as a spray orifice 712, with a venturi valve within the orifice 712 to draw from a reservoir of disinfectant or non-fragrant odor neutralizer, which may be within the bellows 218, when air is discharged through the orifice.

Other dampers 218, as are known int the art, may be used. Resilient objects may be substituted for dampers 218. In a particular alternate embodiment, one or more tapered springs may be used to decelerate the seat 104. The springs are tapered to vary resistance as a function of compression. The springs may be attached between the seat 104 and the rim 214 in any convenient fashion. For example, spring brackets for receiving spring ends may be made with adherent surfaces to stick to underside of the seat 104 and the top of the rim 214. Preferably, the springs are covered with a water-tight, washable cover. In another particular embodiment, a resilient pad may also be used to decelerate the seat. In yet another particular alternate embodiment, the foam may be of gradually increasing density downward along a vertical gradient to maximize resistance as the seat 104 closes. Resilient descent resistors may cause some bouncing of the seat.

Figure 3:
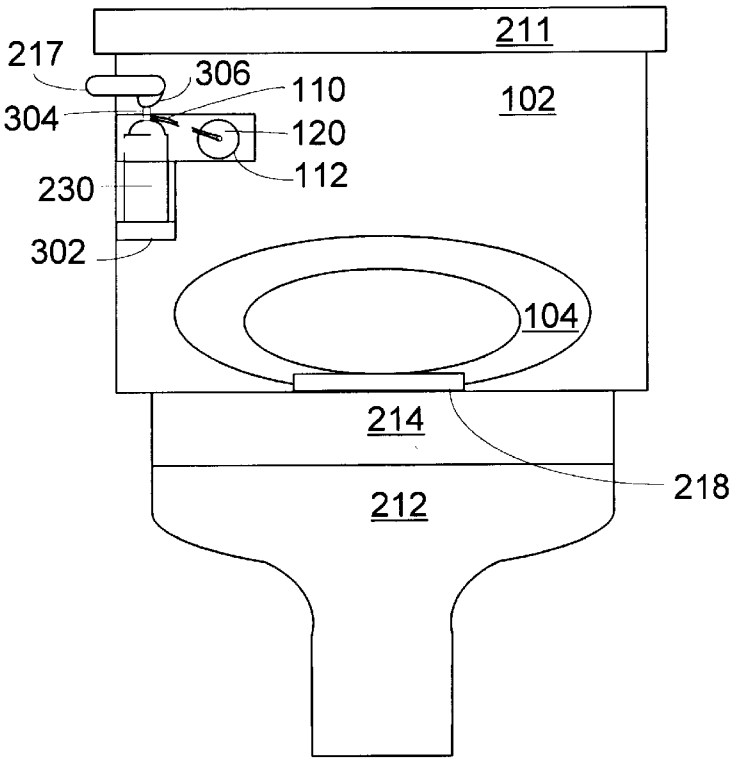
FIG. 3 shows a second exemplary embodiment of the fragrant water closet closer and a toilet.

FIG. 3 shows a second exemplary embodiment of the fragrant water closet closer and a toilet. Bracket 302 holds a can of air freshener 230 in a position that engages the top of the spray nozzle 304 with a mechanical linkage 306 from the axle of the flush lever 217. In the example shown, the mechanical linkage 306 is a cam 306. As the flush lever 217 is pushed down, the cam 306 depresses the spray nozzle 304, releasing air freshener 130 (FIG. 1). The spray nozzle 304 is designed to receive a tube 110 that channels the air freshener 130 (FIG. 1) to expandable chamber 116, moving piston 120 within cylinder 112. Spray nozzles 304 that receive tubes are known in the art and are frequently used with spray lubricants. In a particular variation, the portion of the bracket 302 which holds the can of air freshener 230 is attached to the side of the tank 102 instead of the front. The mechanical linkage 306 between the axle of the flush lever 217 and the spray nozzle 304 becomes more complicated, but is still easily within the knowledge of one of average skill in the art. The bracket 302 enables a consumer to easily change the can of air freshener 230 and reconnect the tube 110. In a particular variation, the spray nozzle 304 and the tube 110 are integral. To change the can of air freshener 230, the nozzle sold with the can is removed and discarded, and the integral nozzle 304 is connected to the can of air freshener 230. In another particular embodiment, the nozzle 304, tube 110, and the cylinder 112 or bellows 502 (FIG. 5A) are integral.

Figure 4A:
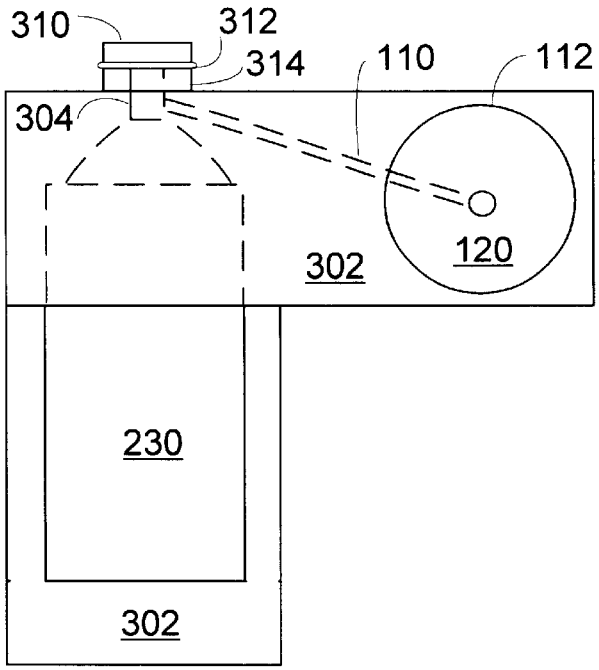
FIGS. 4A–4C shows exemplary details of a portion of an example of the second exemplary embodiment of the fragrant water closet closer.
Figure 4B:
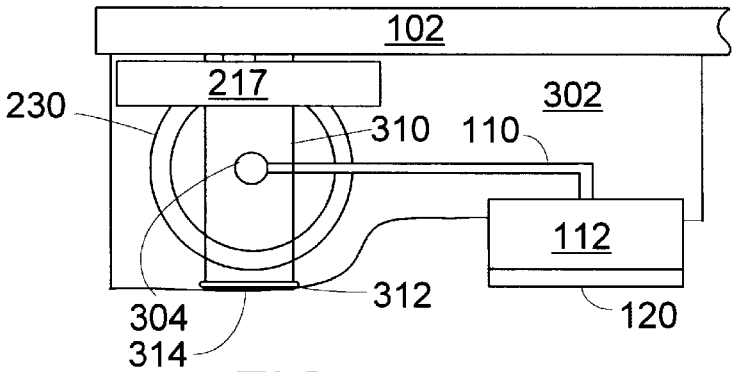
Figure 4C:
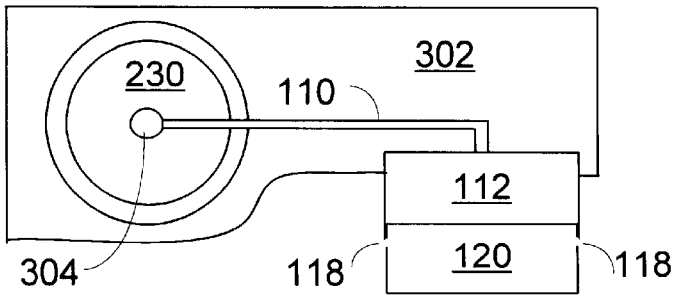

FIGS. 4A–4C show exemplary details of examples of the second exemplary embodiment. FIG. 4A shows a front view of the can of air freshener 230 in bracket 302 attached to toilet tank wall 102. The broken lines in FIG. 4A represent portions of the can 230, nozzle 304, and tube 110 hidden from view. Tube 110 channels the air freshener into cylinder 112 to move piston 120. In some variations, bracket 302 may have smooth, rounded edges and corners and may be padded. The bracket 302 may be adapted for insertion and removal of the can 320 from the front and below. Hinge stand 314 maintains hinge 312 at a level with the top of the nozzle 304. Hinge 312 may be any type of flexible joint, including a flexible portion of plastic. Lever 310 is hinged at the front end and is engaged by flush lever cam 306 (FIG. 3) at the rear end. In an alternate embodiment, the can of air freshener 230 is specifically designed to place the nozzle 304 directly under the cam 306.

FIG. 4B shows a top view of details of an example of the second exemplary embodiment. Cylinder 112 holds piston 120 in a non-extended position. The nozzle 304, tube 110, and cylinder 112 may be integral or may be discrete units. In a particular embodiment, the horizontal and/or vertical location of the cylinder 112 may be adjustable, requiring at least a portion of tube 110 to be flexible. Lever 310 (shown as transparent) is located below flush lever 217 and rests upon the top of nozzle 304. Lever 310 engages a hinge 314 at a front end and a flush lever cam 306 (FIG. 3) at a rear end. When the flush lever 217 is rotated for flushing, the lever 310 is depressed, thereby depressing the nozzle 304, and spraying air freshener through tube 110 into cylinder 112 to push piston 120 outward.

FIG. 4C shows portions of FIG. 4B with the piston 120 extended to the venting position. Vents 118 are open. Features of the actuator (306, 310, 312, 314) are not shown, but are present in this example of the second exemplary embodiment.

Figure 4D:
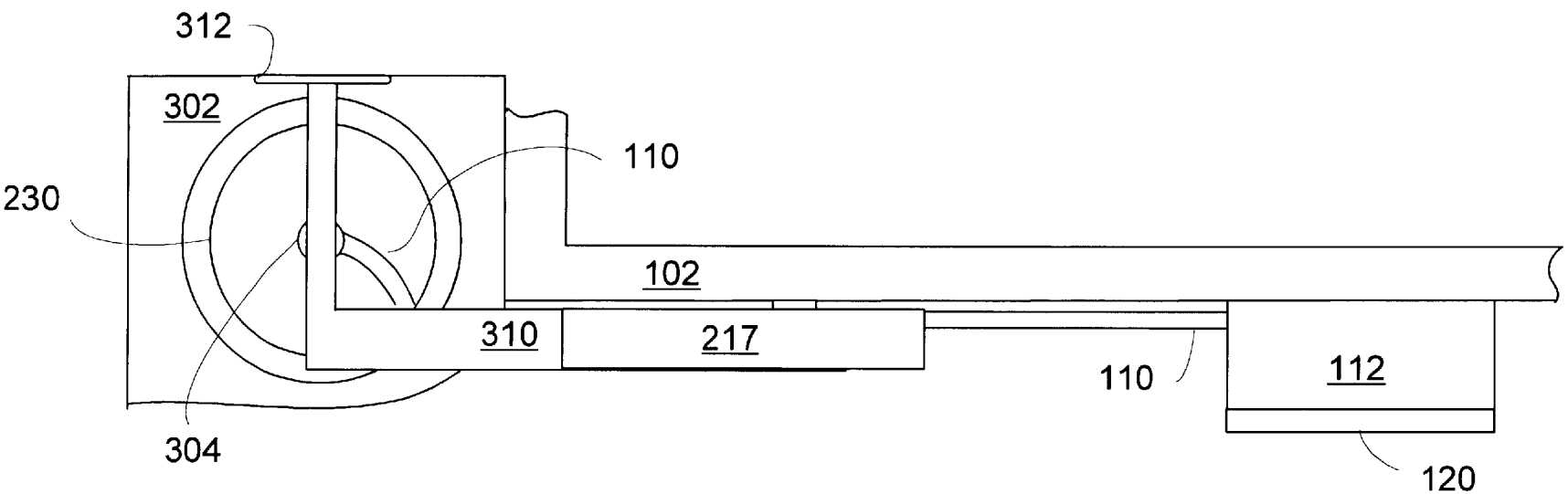
FIG. 4D shows exemplary details of a portion of an alternate version of the second exemplary embodiment of the fragrant water closet closer.

FIG. 4D shows a particular alternate version with a flexible tube 110, wherein only the can 320 is held within the bracket 302, the tube 110 connects to a side of cylinder 112, and the rear surface of cylinder 112 is an adherent surface which may be placed in an advantageous position by the consumer. Lever 310 has an angled configuration so that the bracket 302 may be placed on the side wall 102 of the toilet tank. Lever 310 may connect to hinge 312 at the rear. Hinge 312 is elevated to place lever 310 resting on nozzle 304 and engaging flush lever cam 306 (FIG. 3). Lever 310 is sufficiently rigid that any torsional deformation in operation does not interfere with actuation of the air freshener nozzle 304. Tube 110 may extend from the nozzle 304 to the cylinder 112 underneath the lever 310, or by any convenient route.

Figure 5A:
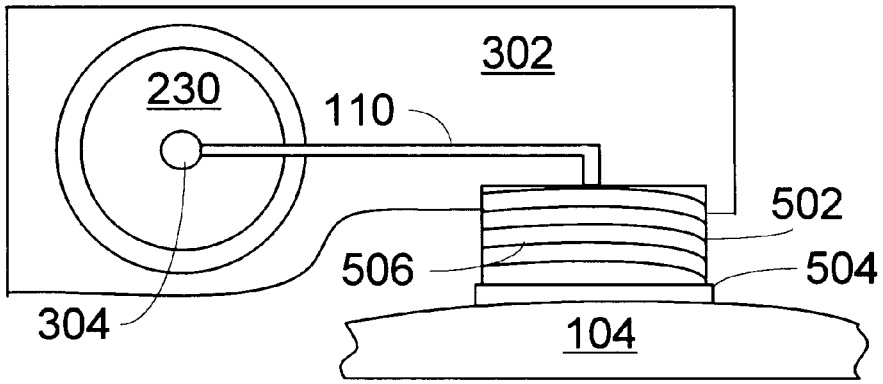
FIGS. 5A–B shows exemplary details of a portion of another alternate version of the second exemplary embodiment of the fragrant water closet closer.
Figure 5B:
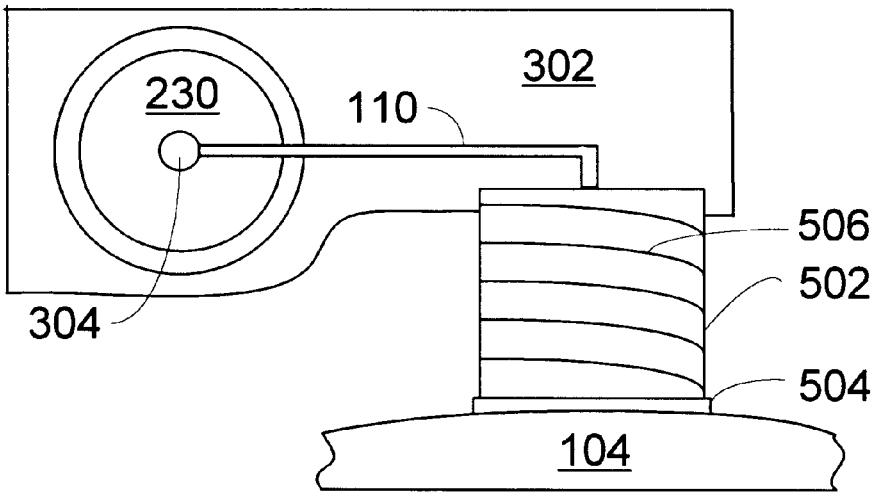

FIG. 5A shows a top view of exemplary features of an example of an alternate version of the second exemplary embodiment, wherein the cylinder 112 and piston 120 have been replaced with a bellows 502. Actuation may be as for FIG. 4B but is not shown to simplify the drawing. Bellows 502 may comprise a weak helical spring 506 as a radial expansion constraint. The spring 506 should have only enough strength to keep the lip 504 engaged with the seat 104 as the seat is being pushed away. Bellows 502 has a flexible, rubbery lip 504 that seals against the curved seat 104. Bellows 502 is open ended at the end with the lip, so the portion of the seat 104 surface covered by the bellows 502 becomes a wall of the expandable chamber 116 (FIG. 1). When pressurized, bellows 502 expands to push the seat 104 away and thereby tip the seat 104 closed, as shown in FIG. 5B. When the seat 104 falls, the fragrant pressurized gas 130 (FIG. 1) in the bellows 502 is immediately discharged into the atmosphere: the entire lipped end is the vent 118. A balloon will also serve in place of a bellows 502, as a bellows comprises a balloon constrained in expansion. However, balloons are not as efficient, and a vent 118 must be provided. The bellows 502 with a lip 504 may be used with the example of FIG. 4D.

FIG. 5B shows the example of the second embodiment with the bellows 502 extended, but still in contact with the seat 104.

FIG. 6 is a side view of a variation of the first exemplary embodiment of the fragrant water closet seat closer and a toilet. Seat 104 is shown in a falling position with the bellows 218 (a damper) deflating. Shown in broken lines is the seat 104 in its barely stable upright position. Bellows 218 can be seen to better advantage in this side view. A portion of the bellows 218 extends under the seat axle 602. (The seat axle support is not shown in this view.) The flapper valve and orifice may be placed on the rear surface of bellows 218 to minimize the need for cleaning. All exterior surfaces of the bellows should be non-porous, water proof, and easy to clean.

Sensor 236 is placed under the lid 211 to detect changes in the water level 620 in the tank 102. When the water level 620 falls, the solenoid 232 is signaled to open. A second sensor 630, detects when the seat 104 is not up and signals the solenoid 232 to deactivate. The signal from sensor 630 may be an override to the signal from sensor 236, operative to prevent the piston 120 from operating when the toilet is flushed with the seat already down. This accommodates people who flush the toilet while still seated.

In the variations shown in FIG. 6, the supply of compressed gas 230 contains only compressed gas 130 (FIG. 1). The supply of fragrance is contained in dedicated chamber 610 and is entrained as the compressed gas passes through. The fragrance may be in solid or liquid form. The supply of fragrance 610 may be in the form of a consumer-replaceable cannister. The cannister may be in-line, as shown, or may connect to the compressed gas line 110 using a "T" connector.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, the fragrant water closet closer may be made integral to the toilet, rather than being attached later. In such a variation, some elements may be permanently placed inside the toilet tank.

What is claimed is:

1. An apparatus for closing a toilet seat, the apparatus comprising:

a supply of compressed gas;

at least one expandable chamber, responsive to a pressure of said compressed gas, so as to exert a force on a toilet seat in a raised position sufficient to cause said seat to move towards a lowered position;

a supply of fragrance, configured to make the compressed gas fragrant before the fragrant compressed gas is released to the atmosphere; and an actuator, operable to introduce compressed gas from the supply of compressed gas into the at least one expandable chamber.

2. The apparatus of claim 1, further comprising a damping mechanism for slowing the descent of at least one of a toilet seat and a toilet cover.

3. The apparatus of claim 2, wherein the damping mechanism comprises at least one of a bellows and a torsional damper.

4. The apparatus of claim 3, wherein the damping mechanism comprises a bellows having a first surface, a second surface, a valve, and an orifice, the bellows adapted to attach the first surface to the underside of the toilet seat and attach the second surface to the rim of the toilet bowl, the bellows operable to inflate through the valve when the seat is raised and deflate through the orifice when the seat descends.

5. The apparatus of claim 1, further comprising a resilient mechanism for slowing the descent of at least one of a toilet seat and a toilet cover.

6. The apparatus of claim 5, wherein the resilient mechanism comprises at least one of at least one tapered coil spring and at least one adaptively shaped block of resilient foam with a density gradient.

7. The apparatus of claim 1, wherein the supply of compressed gas further comprises the supply of fragrance.

8. The apparatus of claim 1, further comprising at least one of a strap, bracket, adherent surface, fixture, and clamp adapted to position and orient the supply of compressed gas.

9. The apparatus of claim 1, further comprising at least one of a strap, bracket, adherent surface, fixture, and clamp adapted to position the at least one expandable chamber to engage the toilet seat.

10. The apparatus of claim 1, wherein the at least one expandable chamber comprises at least one of a balloon, a cylinder with a piston, and a bellows.

11. The apparatus of claim 10, wherein the piston comprises a wall portion of the expandable chamber, a toilet-seat-engaging portion configured mutually and generally parallel to the wall portion, and a mechanism for adjusting a distance between the wall portion and the toilet seat engaging portion.

12. The apparatus of claim 10, wherein at least one of the piston and the cylinder comprises at least one vent, the at least one vent adapted to release pressure in the expandable chamber after the piston has moved a predetermined distance.

13. The apparatus of claim 10, wherein the bellows comprises:

a base;

a flexible, axially extendable tube attached to the base at a first end; and a lip attached to the rim of the tube at a second end, the lip comprising a seal against the toilet seat in the upright position.

14. The apparatus of claim 13, wherein the bellows further comprises at least one radial expansion constraint.

15. The apparatus of claim 14, wherein the at least one radial expansion constraint comprises a helical spring.

16. The apparatus of claim 1, wherein the supply of fragrance comprises at least one of a solid adapted to dissolve in the gas, an aerosol, and a liquid, the supply of fragrance located in at least one of the compressed gas supply, the at least one expandable chamber, and a dedicated chamber in a channel between the compressed gas supply and the expandable chamber.

17. The apparatus of claim 1, wherein the actuator comprises at least one of a mechanical, a fluidic, and an electrical actuator.

18. The apparatus of claim 17, wherein the actuator comprises a sensor adapted to communicate activation to a compressed gas valve, the compressed gas valve further comprising a solenoid.

19. The apparatus of claim 18, wherein the sensor further comprises a sensor adapted to communicating deactivation to the compressed gas valve when the toilet seat is not in the upright position.

20. The apparatus of claim 18, wherein the solenoid has a first position, wherein the first position is adapted to connect the at least one expandable chamber to the atmosphere, and a second position, wherein the second position is adapted to connect the at least one expandable chamber to the supply of compressed gas.

21. The apparatus of claim 18, wherein the sensor is adapted to communicate activation responsive to at least one of:

lowering of the water in the toilet tank;

a person arriving in the vicinity of the toilet;

a person leaving the vicinity of the toilet;

activation of the flush lever; and the sound or vibration produced in flushing the toilet.

22. The apparatus of claim 17 wherein the actuator comprises a mechanical linkage from a flush lever axle to a compressed gas valve.

23. The apparatus of claim 22, wherein the mechanical linkage comprises a cam on the flush lever axle.

24. The apparatus of claim 22, wherein the mechanical linkage further comprises a lever engaging the cam, the lever further engaging a valve actuator and a hinge, the valve actuator configured to dispense compressed gas when depressed, the lever operable to depress the valve actuator responsive to the flush lever being rotated to the flush position.

25. The apparatus of claim 24, wherein the supply of compressed gas further comprises the supply, of fragrance, the supply of compressed fragrant gas further comprising a valve and a valve actuator, wherein the valve actuator comprises a nozzle.

26. The apparatus of claim 25, wherein the nozzle further comprises at least one of a tube, a bellows, and a cylinder.

27. The apparatus of claim 1, wherein the compressed gas comprises a mixture of compressed gases.

28. The apparatus of claim 27, wherein the mixture of compressed gases, comprises compressed air.

29. A method of closing a toilet, the method comprising the steps of:

providing a supply of compressed gas;

providing a supply of fragrance, configured to make the compressed gas fragrant before the fragrant compressed gas is released to the atmosphere;

providing an actuator, operable to introduce compressed gas from the supply of compressed gas into the at least one expandable chamber;

placing an expandable chamber engagingly between a fixed surface and a toilet seat;

expanding the chamber with said fragrant compressed gas along an axis between the fixed surface and the toilet seat, the expansion operative to tip the toilet seat closed; and venting the fragrant gas from the expanded chamber.

30. The method of claim 29, further comprising a second step of detecting a condition indicating that the toilet seat should close.

31. The method of claim 29, further comprising a final step of decelerating the toilet seat as it closes.

* * * * *